US010735875B2

(12) United States Patent
Møller et al.

(10) Patent No.: US 10,735,875 B2
(45) Date of Patent: Aug. 4, 2020

(54) SEALING EARPIECE

(71) Applicant: Oticon A/S, Smørum (DK)

(72) Inventors: Kenneth Rueskov Møller, Smørum (DK); Svend Oscar Petersen, Smørum (DK); Anders Thule, Smørum (DK); Troels Holm Pedersen, Smørum (DK)

(73) Assignee: OTICON A/S, Smørum (DK)

( * ) Notice: Subject to any disclaimer, the term of this patent is extended or adjusted under 35 U.S.C. 154(b) by 582 days.

(21) Appl. No.: 15/234,178

(22) Filed: Aug. 11, 2016

(65) Prior Publication Data

US 2017/0070832 A1 Mar. 9, 2017

(30) Foreign Application Priority Data

Sep. 8, 2015 (EP) ..... 15184346
Oct. 27, 2015 (EP) ..... 15191564

(51) Int. Cl.
*H04R 25/02* (2006.01)
*H04R 25/00* (2006.01)
*H04R 1/10* (2006.01)

(52) U.S. Cl.
CPC ..... *H04R 25/652* (2013.01); *H04R 25/405* (2013.01); *H04R 25/456* (2013.01); *H04R 25/656* (2013.01); *H04R 25/658* (2013.01); *H04R 1/1016* (2013.01); *H04R 2225/025* (2013.01); *H04R 2460/09* (2013.01); *H04R 2460/11* (2013.01)

(58) Field of Classification Search
CPC ..... H04R 25/652
USPC ..... 381/323, 325, 328, 322, 324, 74; 623/19.12; 81/3.32; 181/135
See application file for complete search history.

(56) References Cited

U.S. PATENT DOCUMENTS 7,130,437 B2 * 10/2006 Stonikas ..... H04R 25/652 381/322
8,180,085 B2 * 5/2012 Saltykov ..... H04R 25/652 381/324
8,438,951 B1 * 5/2013 McCabe ..... B67B 7/24 7/151

(Continued)

FOREIGN PATENT DOCUMENTS

WO WO 01/69972 A2 9/2001
WO WO 2004/077924 A2 9/2004

(Continued)

OTHER PUBLICATIONS

SRS Solutions, Quickparts, "Injection Mold Design Tips—Overmolding," http://injectionmolding.blog.quickparts.com/2012/06/04/injection-mold-design-tips-overmolding/, XP055320970, Jun. 4, 2012, pp. 1-4.

*Primary Examiner* — Md S Elahee
(74) *Attorney, Agent, or Firm* — Birch, Stewart, Kolasch & Birch, LLP.

(57) ABSTRACT

An earpiece configured to be worn in an ear canal of a user is disclosed. The earpiece includes an adaptor having an interface configured to receive at least a part of a speaker unit and hereby be attached to the speaker unit. The earpiece includes an adaptable part, preferably a part made of a foam material or a gel material shapeable to fit the ear canal of the user. The adaptable part at least partly surrounds the adaptor. The adaptor has a sound outlet channel and at least one vent.

8 Claims, 12 Drawing Sheets

(56) References Cited

U.S. PATENT DOCUMENTS

| | | | | |
|---|---|---|---|---|
| 2006/0069445 | A1* | 3/2006 | Ondrla | A61F 2/40 623/19.12 |
| 2007/0206826 | A1 | 9/2007 | Rohrlein | |
| 2008/0285782 | A1 | 11/2008 | Gommel et al. | |
| 2013/0129128 | A1 | 5/2013 | Wagner et al. | |
| 2014/0138179 | A1* | 5/2014 | Burton | H04R 1/1016 181/135 |
| 2015/0146880 | A1* | 5/2015 | Boni | H04R 1/1008 381/74 |

FOREIGN PATENT DOCUMENTS

| | | | |
|---|---|---|---|
| WO | WO 2009/009794 | A1 | 1/2009 |
| WO | WO 2013/126645 | A2 | 8/2013 |

* cited by examiner

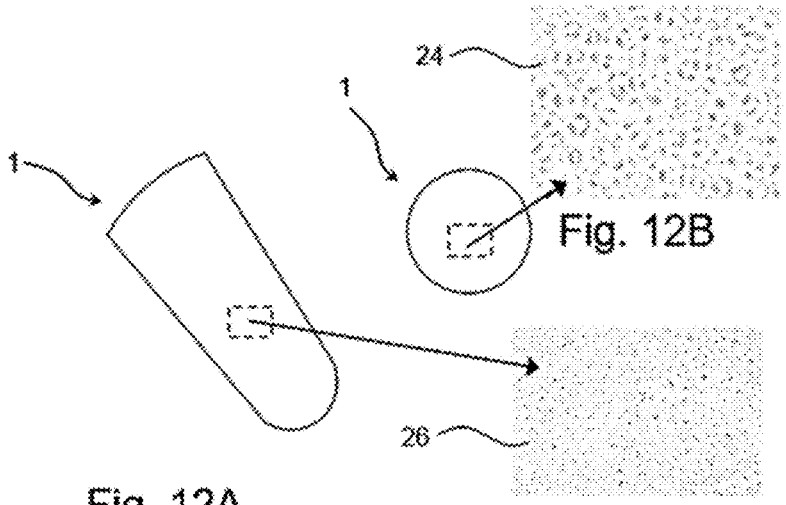
Fig. 12B
Fig. 12A
Fig. 12C
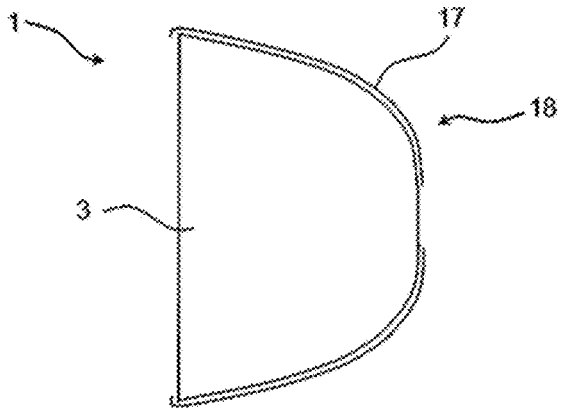
Fig. 13

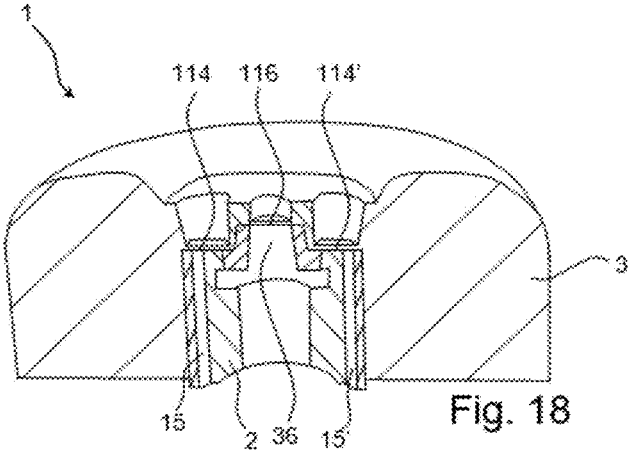
Fig. 18
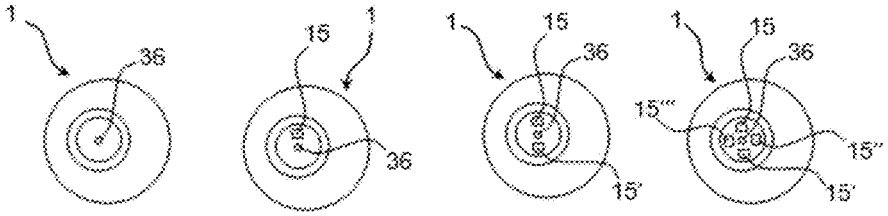
Fig. 19A Fig. 19B Fig. 19C Fig. 19D
Fig. 20A
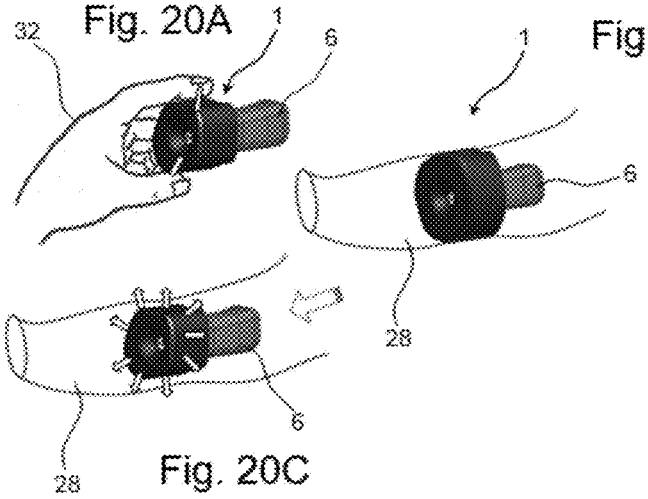
Fig. 20B
Fig. 20C

SEALING EARPIECE

FIELD OF DISCLOSURE

The present disclosure relates to an earpiece at least partly made in an adaptable material configured to provide an efficient sealing against the ear canal in order to reduce the acoustic feedback.

BACKGROUND

In a hearing device, in which both a receiver and a microphone are present in the ear canal, the microphone and the receiver are provided in the speaker unit housing. When the microphone is placed in a short distance from the receiver output, it is required to seal the sound from the receiver output in order to avoid acoustic feedback In current receiver-in-the-canal (RIC) or receiver-in-the-ear (RITE) hearing devices, which are major products in a dispenser's hearing aid sales, the microphone is not placed in the ear canal. Therefore, the sealing (usually provided by a dome element) is not as essential in present RIE/RITE concepts as in hearing devices in which both the receiver and the microphone are placed within the ear canal.

Prior art silicone domes/earpieces can be attached to and detached from the speaker unit by the end user. The silicone domes/earpieces are replaced on a regular basis for hygienic reasons. Prior art domes/earpieces are typically arranged in the soft part of the ear canal.

Since domes/earpieces typically are produced in a limited number of fixed sizes, it is often not possible for the end user to buy earpieces/domes that fit and sufficiently seal against the ear canal.

Accordingly, when using prior art domes/earpieces, it is difficult and sometimes impossible to buy a dome/earpiece of correct size to fit the ear canal of the hearing device user. If a dome/earpiece is too small, the user will experience a leaking and thus incomplete sealing. On the other hand, if a dome/earpiece is too large, the user will experience a leaking and thus incomplete sealing due to the folding of the dome/earpiece. Additionally, if the dome/earpiece is too large, the comfort in the ear canal will be compromised. Furthermore, the prior art silicone domes/earpieces are limited to adapt to various shapes/bends of ear canals.

Therefore, there is a need to provide an earpiece that can be produced in a limited number of sizes and still provide a complete sealing in order to reduce or even eliminate acoustic feedback. There is also a need for providing an earpiece that is comfortable to wear.

SUMMARY OF THE DISCLOSURE

Preferred embodiments of the present disclosure can be achieved by an earpiece as defined in claim 1 and by a method as defined in claim 13. Other preferred embodiments are defined in the dependent sub claims, explained in the following description and illustrated in the accompanying drawings.

According to an aspect of the disclosure, the earpiece is configured to be worn in an ear canal of a user, wherein the earpiece comprises an adaptor having an interface configured to receive at least a part of a speaker unit and hereby be attached to the speaker unit, wherein the earpiece comprises an adaptable part, preferably a part made of a foam material or a gel material shapeable to fit the ear canal of the user, wherein the adaptable part at least partly surrounds the adaptor, wherein the adaptor comprises a sound outlet channel and at least one vent.

Hereby, it is possible to provide an earpiece that is comfortable to wear and can be produced in a limited number of sizes and still provide a complete sealing in order to reduce or even eliminate acoustic feedback. Furthermore, the earpiece is configured to provide a tight sealing against the ear canal of a variety of different sized ear canals.

It is advantageous that the earpiece is capable of reducing or even eliminating the acoustic feedback caused by sound emitted from the receiver and being reflected by the ear drum. The acoustic feedback reduction or elimination can be achieved by having an earpiece that is configured to adapt (change its shape to fit) to the inner walls of the ear canal upon insertion into the user's ear canal.

The effective sealing of the earpiece against the ear canal prevents sound from passing the earpiece (between the walls of the ear canal and the walls and the earpiece).

When using prior art earpieces, unwanted sound passing the earpiece when arranged in the ear canal, typically arise due to leakage channels created between the earpiece (i.e. a sealing part of the earpiece) of the hearing device and the inner walls of the ear canal. As will be apparent from the description, such leakage problems arise due to the combination of individual ear canals variations and the limited number of available earpiece sizes. An earpiece comprising an adaptable part, e.g. a part made of a foam material or a gel material shapeable to fit the ear canal of the user, allows the earpiece to adapt to the geometry of the ear canal when inserted into the ear canal. The adaptable part is resilient and flexible allowing the adaptable part to be elastically deformed (compressed, bent or twisted)

The earpiece is configured to be worn in an ear canal of a user. The ear piece may be configured to be positioned in any portion of the ear canal. The ear piece may be configured to be positioned in the canal's bony region. The ear piece may be configured to be positioned in the elastic cartilage part (outer third) of the ear canal.

The earpiece comprises an adaptor having an interface configured to receive at least a part of a speaker unit and hereby be attached to the speaker unit. The interface may be a structure having any geometry and size suitable for receiving at least a part of a speaker unit in order to allow the speaker unit to be attached to the adaptor.

The earpiece comprises an adaptable part, preferably a part made of a foam material or a gel material shapeable to fit the ear canal of the user, wherein the adaptable part at least partly surrounds the adaptor.

The adaptable part may include a composition to conform to the ear canal's bony region wall to seat the earpiece and acoustically seal it in the ear canal to inhibit feedback therein.

Individual variation with respect to the natural bends of the ear canal of different users requires that the earpiece is made of a material capable of adapting the geometry thereto. Accordingly, the earpiece according to the disclosure is made of a foam material or gel material enabling the earpiece to adapt to the geometry of the ear canal to which the earpiece is inserted. Thus, the term "adaptable" should be interpreted as a material capable of changing configuration upon insertion into the ear canal. When inserted into the ear canal, the outer sides of the earpiece will tend to follow the geometry of the ear canal.

The adaptor comprises a sound outlet channel that may have any suitable size and geometry. The sound outlet channel may be centrally arranged and extend along the longitudinal axis of the earpiece. The adaptor comprises at least one vent. The vent may have any suitable geometry. At least a portion of the vent may extend parallel to the longitudinal axis of the earpiece and/or to at least a portion of the sound outlet channel.

According to an embodiment of the disclosure, the adaptor of the earpiece defines an interface to a speaker unit. Within the meaning of the disclosure, an adaptor should be understood as an element, unit or other component which are provided as a part of the earpiece. The adaptor may be integrated into at least a part of the earpiece and is configured to receive at least a part of a speaker unit.

Accordingly, the interface of the adaptor should be construed to define a structure of the adaptor having a configuration that enables the adaptor to receive at least a part of the speaker unit and keep the speaker unit in place within the adaptor.

It is important to provide a sufficient fixation of the speaker unit to the adaptor. In order to achieve a sufficient fixation of the speaker unit to the adaptor, the geometry and surface structure of the interface may be constructed to ensure, that the speaker unit can only be removed from the adaptor by applying a force exceeding 2.5N. In this way, it is secured that the earpiece is not left in the ear when removing the speaker unit.

According to another aspect of the disclosure, at least one vent is separated from the sound outlet channel when the speaker unit is attached to the earpiece.

Hereby, it is possible to provide an earpiece, in which the feedback performance increases, especially in the high frequency range. By having a vent (and thus a vent outlet) that is separated from the sound outlet channel, acoustic feedback can be significantly reduced. Therefore, it may be an advantage to have one or more vents that are separated from the sound outlet channel.

According to another aspect of the disclosure, at least one vent and the sound output channel share the same channel.

According to a further aspect of the disclosure, the at least one vent is separated from the sound outlet channel by a barrier structure, wherein the barrier structure at least partly surrounds the sound outlet channel.

Hereby, it is possible to provide an earpiece that reduces the acoustic feedback in a simple manner. It is possible to produce the earpiece by using a moulding process.

The barrier structure may be produced in the same material as the surrounding portions of the earpiece.

According to another aspect of the disclosure, the at least one vent has a cylindrical shape and extends along the longitudinal axis of the earpiece. The cross-section of the vent may be circular, oval, polygonal, triangular, rectangular, square, pentagonal, hexagonal, octagonal or have any other suitable shape.

It may be an advantage that the vent is radially displaced relative to the longitudinal axis of the earpiece.

According to an aspect of the disclosure, at least a portion of the vent has a cross-sectional area that is smaller than the cross-sectional area of the sound outlet channel According to a further aspect of the disclosure, the entire portion of the vent has cross-sectional area that is smaller than the cross-sectional area of the sound outlet channel.

According to an aspect of the disclosure, the vent has a conical geometry. It may be an advantage, that the cross-sectional area of any portion of the vent is smaller than the cross-sectional area of the sound outlet channel.

According to an aspect of the disclosure, the sound outlet channel has a cylindrical shape and extends concentrically or basically concentrically along the longitudinal axis of the earpiece. The cross-section of the vent may be circular, oval, polygonal, triangular, rectangular, square, pentagonal, hexagonal, octagonal or have any other suitable shape.

According to an aspect of the disclosure, the vent comprises a first section and a second section connected to the first section by one or more additional sections, wherein the first section is connected to the end of the earpiece that is intended to face the eardrum when inserted into the ear canal, wherein the second section is connected to the opposite end of the earpiece, wherein at least the distal portion of the second section has a larger cross-sectional area than the first section.

Hereby, it is possible to provide an efficient vent and at the same time limit the acoustic feedback.

According to an aspect of the disclosure, the second section is connected to the first section by an additional section having a smaller cross-sectional area than the first section.

Hereby, the additional section reduces the acoustic feedback.

According to an even further aspect of the disclosure, the second section is connected to the first section by an additional section comprising:

- a first structure having a smaller cross-sectional area than the first section and
- a second structure extending basically perpendicular to the longitudinal axis of the first section of the vent and to the longitudinal axis of the first structure, wherein the length of the second structure exceeds the width of the first structure.

Hereby, it is possible to reflect sound waves (reflected by the eardrum) on the surface of the second structure. Accordingly, a feedback cancellation may be achieved.

According to another aspect of the disclosure, the adaptor comprises a snout element provided in a first portion of the earpiece, wherein the barrier structure is provided in a different second portion of the earpiece.

Hereby, the snout element may allow for an effective venting of the earpiece, hereby reducing or even eliminating the occlusion effect.

According to a further aspect of the disclosure, the different second portion is separated from the snout element and extends in extension of the snout element in a direction towards the end of the earpiece that faces the eardrum when inserted into the ear canal.

Hereby, it is possible to provide an earpiece that is capable of reducing or even eliminating the occlusion effect by providing a large venting volume in the first portion. Accordingly, it is possible to provide an earpiece that is comfortable to wear. At the same time, it is possible to reduce or even eliminate the acoustic feedback due to the structure and position of the vent separated from the sound outlet channel by the barrier structure.

According to another aspect of the disclosure, the interface comprises a groove portion configured to receive the speaker unit.

Hereby, it is possible to provide a simple and reliable interface structure adapted to receive the speaker unit.

According to a further aspect of the disclosure, the interface comprises a groove portion shaped as an undercut configured to lockingly receive the speaker unit.

Hereby, a reliable attachment of the speaker unit to the interface structure can be received.

According to a further aspect of the disclosure, the interface comprises a groove portion extending radially from the area surrounding the sound outlet channel.

Hereby, it is possible to provide a groove portion that is configured to receive and maintain the speaker unit in an easy manner.

According to a further aspect of the disclosure, the adaptable part is essentially symmetric with respect to its longitudinal axis.

Hereby, the insertion of the speaker unit can be eased since the adaptable part has no preferred orientation during insertion of the adaptable part.

According to an even further aspect of the disclosure, the adaptable part is basically disc-shaped. According to another aspect of the disclosure, the adaptable part is basically dome-shaped.

A disc-shaped or dome-shaped geometry may be advantageous since it is symmetric and capable of adapting shape in order to seal against the ear canal when inserted into the ear canal.

According to an even further aspect of the disclosure, the adaptable part is arranged at the outermost portion of the earpiece.

Hereby, the outermost portion of the earpiece is capable to adapting to the ear canal and hereby seal against the ear canal.

According to an even further aspect of the disclosure, the adaptor is arranged at the central part of the adaptable part.

Hereby, it is possible to provide an earpiece having an interface configured to receive at least a part of a speaker unit at the central portion of the earpiece.

According to an even further aspect of the disclosure, the adaptable part fully surrounds the adaptor in the axial direction.

Hereby, the adaptor is covered by the adaptable part when seen in the axial direction. By axial direction is meant along the direction of the longitudinal axis (of the adaptor).

According to an even further aspect of the disclosure, the adaptor and the adaptable part is made as a single one-piece body.

Thus, the adaptor and the adaptable part are permanently attached to each other to form a single component.

According to an even further aspect of the disclosure, the adaptor is made of an elastomer, such as silicone or another suitable elastomer. Furthermore, the adaptor may be configured to bind to at least a polyurethane material. In addition, the adaptor may be made in a thermoplastic polyurethane (TPU), or other suitable polyurethane and/or polymer.

Hereby, it is possible to provide an adaptor resilient and flexible enough to receive a speaker unit and keep it fixed to the adaptor.

According to an even further aspect of the disclosure, the adaptable part is made in polyurethane (PUR), polyisocyanurate (PIR), polyvinyl chloride (PVC) or another suitable memory foam or a suitable gel.

According to an even further aspect of the disclosure, the adaptable part is made in a softer material than the adaptor.

Hereby, it is possible to receive the speaker unit and keep it fixed to the adaptor. By applying an adaptor material that is harder than the adaptable part, the vent may be restricted from being compressed and extended, when the earpiece is arranged or being inserted into an ear canal.

According to an even further aspect of the disclosure, the central region of the earpiece, in which the adaptor is arranged, has a first flexibility, wherein the edge end portion of the earpiece has a second flexibility that is larger than the first flexibility.

Hereby, the earpiece is sufficiently resistant to avoid collapse of the adaptor and earpiece upon insertion into the ear canal of a user.

According to an even further aspect of the disclosure, the earpiece has a first surface and a second (opposite) surface, where the first surface is configured to be directed towards the eardrum when inserted in the ear canal of a user, wherein the second surface is configured to be directed in the opposite direction towards the opening to the pinna, wherein the second surface is provided with a structured surface.

According to an even further aspect of the disclosure, the structured surface comprises a plurality of tracks (recesses) extending radially along the second surface.

The structures of the structured surface make it easier to collapse the earpiece without at the same time folding the earpiece. Hereby, it is possible to avoid folding of the earpiece. Accordingly, leakages between ear canal and the earpiece can be avoided or reduced.

The structured surface may comprise a plurality of curved tracks extending radially along the second surface. The curved tracks may be non-randomly or uniformly distributed on the structured surface. The thickness of the curved tracks may be constant along the radial direction of the second surface. The thickness of the curved tracks may vary along the radial direction of the second surface.

The structured surface may comprise a plurality of rings. The diameter of each ring may increase radially along the structured surface. The rings may be uniformly distributed.

The structured surface may comprise uniformly distributed structures, such as elongated triangles, elongated structures directed radially inwardly.

According to an aspect of the disclosure, the plurality of tracks (recesses) are uniformly distributed along the second surface.

According to another aspect of the disclosure, the structured surface comprises a plurality of concentric ring-shaped structures, wherein the ring-shaped structures preferably are evenly distributed along the second surface.

According to a further aspect of the disclosure, the earpiece comprises a pull-off handle.

Hereby, removal of the earpiece from the ear canal is eased.

According to another aspect of the disclosure, the earpiece comprises:

- a disk-shaped first part, comprising at least part of the adaptor;
- a dome-shaped, second part and
- an intersection part connecting the first part and the second part, wherein the intersection part comprises the remaining part of the adaptor.

According to another aspect of the disclosure, the first part, second part and the intersection part is a one-piece body made in one material.

Hereby, a user-friendly one-piece component can be achieved.

According to a further aspect of the disclosure, the vent is in fluid communication with a receiver output.

According to a further aspect of the disclosure, the vent is not in fluid communication with a receiver output.

According to a further aspect of the disclosure, at least a portion of the outer sider of the earpiece is coated with a coating material for prolonging the durability of the earpiece.

Hereby, the durability of the earpiece can be increased.

According to a further aspect of the disclosure, the method is a method for producing an earpiece configured to be worn in an ear canal of a user, wherein the earpiece comprises an adaptor having an interface configured to receive at least a part of a speaker unit and hereby be attached to the speaker unit, wherein the earpiece comprises an adaptable part, preferably a part made of a foam material or a gel material shapeable to fit the ear canal of the user, wherein the adaptable part at least partly surrounds the adaptor, wherein the method comprises the following steps:

Moulding the adaptor by means of a first mould;

Arranging the moulded adaptor in a second mould;

Overmoulding the adaptor;

Removing the earpiece from the second mould.

Hereby it is possible to mass-produce the earpiece in a manner, in which a high quality can be achieved.

The step of moulding the adaptor by means of a first mould may be conducted by applying any suitable mould configured to produce an adaptor having the desired geometrical shape and size. The step of moulding the adaptor may be carried out by using an injection moulding process in which pressurised material is injected into the mould.

When the adaptor moulding process is terminated, the moulded adaptor is arranged in a second mould adapted to receive the moulded adaptor.

The next step is to overmould the adaptor while the adaptor is arranged on the second mould. Accordingly, it is possible to produce a single one-piece body comprising an inner element (the adaptor) and an outer layer (e.g. a foam part or gel part) attached thereto. By using an overmoulding technique, it is possible to provide an earpiece that comprises an adaptor made in a first material (e.g. having a first hardness) and an outer layer (e.g. a foam part or gel part) made in another material that may have other mechanical properties (such as hardness) than the adaptor.

The method comprises the step of removing the earpiece from the second mould.

According to an even further aspect of the disclosure, the method comprises the following steps:

Moulding the adaptor by means of a first mould and a first core;

Removing the adaptor from the first mould while the adaptor is still on the first core;

Removing the adaptor from the first core;

Mounting the adaptor on a second core;

Arranging the second core in a second mould;

Overmoulding the adaptor;

Removing the earpiece from the second mould while the earpiece is still on the second core;

Removing the earpiece from the second core.

According to another aspect of the disclosure, the method comprises the following steps:

Moulding the adaptor by means of a first mould and a first core;

Removing the adaptor from the first mould while the adaptor is still on the first core;

Removing the adaptor from the first core;

Priming the adapter;

Thermally curing the primer;

Mounting the adaptor on a second core;

Arranging the second core in a second mould;

Overmoulding the adaptor;

Removing the earpiece from the second mould while the earpiece is still on the second core;

Removing the earpiece from the second core;

Removing membrane(s) and/or flash.

By carrying out the step of priming the adaptor and thermally curing the primer, it is possible to at least partly cover the outside surface of the adaptor with a membrane. The membrane prevents the material injected during the overmoulding process from having access to certain areas of the adaptor. Hereby, it is possible to prevent, material injected during the overmoulding process to excess the vent area(s) and/or other cavities/channels. Moreover, the primer facilitates the earpiece to chemically bond to the adaptor being overmoulded. Hereby, the lifetime of the earpiece can be increased.

The primer may be sprayed on the adaptor surface. Hereafter the adaptor may be placed in an oven to thermally cure the primer.

The step of removing membrane(s) and/or flash is carried out in order to provide access to and hereby open the vent(s) and the sound outlet channel.

According to another aspect of the disclosure, the method comprises the following steps:

Priming the earpiece;

Thermally curing the primer;

Hereby, it is possible to at least partly cover the earpiece with a membrane. Such membrane can constitute a protection layer of the earpiece.

According to a further aspect of the disclosure, the earpiece is made by using a method according to the disclosure.

BRIEF DESCRIPTION OF THE DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effects will be apparent from and elucidated with reference to the illustrations described hereinafter in which:

FIG. 12A shows a schematic view of an earpiece according to an embodiment of the disclosure;

FIG. 12B shows an end view of the earpiece shown in FIG. 12A and a close-up view of the structure of the earpiece;

FIG. 12C shows a close-up view of the outside surface of the earpiece shown in FIG. 12A;

FIG. 13 shows a schematic side view of an earpiece according to an embodiment of the disclosure;

FIG. 18 shows a schematic cross-sectional view of an earpiece according to an embodiment of the disclosure;

FIG. 19A shows a schematic top view of an earpiece according to an embodiment of the disclosure;

FIG. 19B shows a schematic top view of an earpiece according to another embodiment of the disclosure;

FIG. 19C shows a schematic top view of an earpiece according to a further embodiment of the disclosure;

FIG. 19D shows a schematic top view of an earpiece according to an even further embodiment of the disclosure;

FIG. 20A shows a perspective view of an earpiece according to an embodiment of the disclosure being compressed;

FIG. 20B shows a perspective view of the earpiece shown in FIG. 20A arranged in the ear canal of a user;

FIG. 20C shows a perspective view of how the earpiece shown in FIG. 20B expands radially while being arranged in the ear canal;

DETAILED DESCRIPTION OF THE DISCLOSURE

Figure 1A:
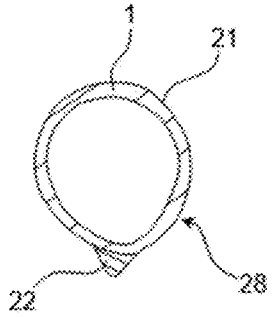
FIG. 1A shows a cross-sectional view of an ear canal.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus are described by various blocks, functional units, modules, components, steps, processes etc. (collectively referred to as "elements"). Depending upon the particular application, design constraints or other reasons, these elements may be implemented using electronic hardware, computer programs, or any combination thereof.

The earpiece according to the disclosure may be used with any suitable hearing device. A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device adapted to receive an audio signal electronically, possibly modifying the audio signal and providing the possibly modified audio signals as an audible signal to at least one of the user's ears. Such audible signals may be provided in the form of an acoustic signal radiated into the user's outer ear.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing device, and/or ii) arranging the hearing device entirely or partly in the pinna and/or in the ear canal of the user such as in an In-the-Ear type hearing device or In-the-Canal/Completely-in-Canal type hearing device.

A "hearing system" refers to a system comprising one or two hearing devices. The hearing system may include auxiliary device(s) that communicate with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of the following: remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, or a PC. The audio gateway is further adapted to select and/or combine an appropriate signal out of the received audio signals (or combination of signals) for transmission to the at least one hearing device. The remote control is adapted to control functionality and operation of the at least one hearing devices. The function of the remote control may be implemented in a SmartPhone or another electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such a directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker.

Referring now in detail to the drawings for the purpose of illustrating preferred embodiments of the disclosure, FIG. 1A illustrates a schematic cross-sectional view of an ear canal 28 having an inner wall 21 provided with a teardrop-shaped area 22.

When a prior art earpiece 1 is inserted into an ear canal 28 of this geometry, acoustic feedback will occur when some of the amplified sound leaks through the teardrop-shaped area 22 and is picked up by the hearing aid microphone, when the earpiece 1 is used in a hearing aid. It can be seen that the earpiece 1 fits the inner wall 21 of the ear canal 28, except from the area of the teardrop abrupt 22. Accordingly, the prior art earpiece 1 shown in FIG. 1A cannot provide a sufficient sealing against the inner wall 21 of the ear canal 28.

Figure 1B:
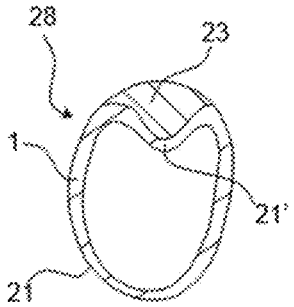
FIG. 1B shows a cross-sectional view of a prior art earpiece folding.

FIG. 1B illustrates a cross-sectional view of a prior art earpiece 1 folding. The earpiece 1 is arranged in an ear canal 28 having an inner wall 21. Since, the ear canal 28 has a slightly smaller cross-sectional area than the earpiece 1; the earpiece 1 is compressed and is subject to a permanent shape change. The earpiece has a folding 21, which causes creation of a leaking area 23. The leaking area 23 will cause acoustic feedback as some of the amplified sound (produced by a receiver) leaks through the leaking area 23 and is picked up by the hearing aid microphone, when the earpiece 1 is used in a hearing aid. It can be seen that the earpiece 1 fits the inner wall 21 of the ear canal 28 except from the leaking area 23. Therefore, the prior art earpiece 1 shown in FIG. 1B does not provide a sufficient sealing against the inner wall 21 of the ear canal 28. The problem indicated in FIG. 1B may occur when the cross-sectional area of the earpiece is "too large" compared to the cross-sectional area of the ear canal 28.

Figure 1C:
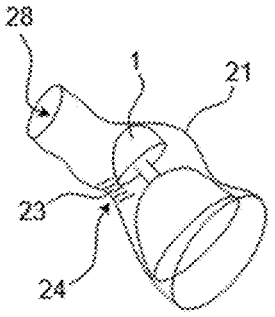
FIG. 1C shows a perspective view of a prior art hearing aid in an ear canal.

FIG. 1C shows a perspective view of a prior art hearing aid arranged in an ear canal 28 having an inner wall 21. The hearing aid comprises an earpiece 21 that does not seal tight against the inner wall 21 of the ear canal 28. In fact, a leaking area 23 is created at the protrusion structure 24 of the ear canal 28. Accordingly, when the earpiece 1 is used in a hearing aid, the leaking area 23 will cause acoustic feedback when some of the amplified sound (produced by a receiver) leaks through the leaking area 23 and is picked up by the microphone of the hearing aid. Accordingly, FIG. 1C exemplifies that the earpiece 1 does not fit the inner wall 21 of the ear canal 28 and for that reason, the earpiece 1 shown in FIG. 1C does not provide a sufficient sealing against the inner wall 21 of the ear canal 28. The problem indicated in FIG. 1C may occur when the cross-sectional area of the earpiece is "too small" compared to the cross-sectional area of the ear canal 28.

As illustrated in FIG. 1A, FIG. 1B and FIG. 1C, acoustic feedback occurs when the prior art earpieces 1 do not seal against the ear canal 28. Therefore, it would be desirable to have an earpiece capable of efficiently sealing off the ear canal 28 in order to avoiding leakage.

Figure 2A:
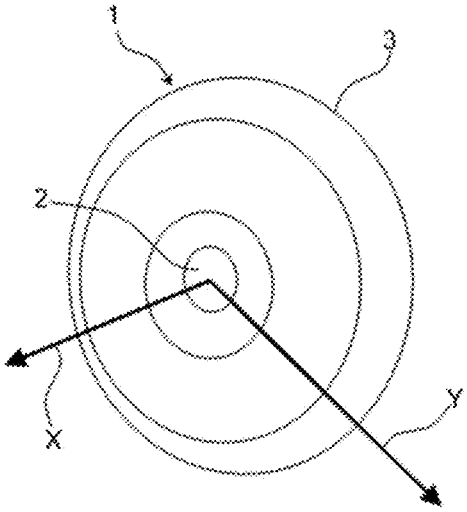
FIG. 2A shows a schematic perspective view of an earpiece according to an embodiment of the disclosure.

FIG. 2A illustrates a schematic perspective front view of an earpiece 1 according to an embodiment of the disclosure. The earpiece 1 is disc-shaped and configured to be worn in an ear canal of a user. The earpiece 1 comprises a centrally arranged adaptor 2. As will become apparent in the following description, the adaptor 2 has an interface having a geometry adapted to receive a speaker unit in order to keep the speaker unit fixed to the adaptor 2. The earpiece 1 comprises an adaptor 2 and a surrounding part 3. The surrounding part made of a foam material or a gel material that can be shaped to fit the ear canal of the user, when the earpiece 1 is arranged in the ear canal of a user.

Accordingly, the earpiece 1 is comfortable to wear and can be produced in a limited number of sizes and still provide a complete sealing in order to reduce or even eliminate acoustic feedback. Moreover, the earpiece 1 is capable of providing a tight sealing against the ear canal of a variety of different sized ear canals, due to the flexibility and compressibility of the earpiece 1.

The earpiece 1 comprises a longitudinal axis X and a lateral axis Y (extending perpendicular to the longitudinal axis X). The earpiece 1 has rotational symmetry with respect to rotations about the longitudinal axis X. It may be an advantage that the earpiece 1 has large compressibility along the lateral axis Y in order to allow radial compression of the earpiece 1 when inserted into an ear canal.

Figure 2B:
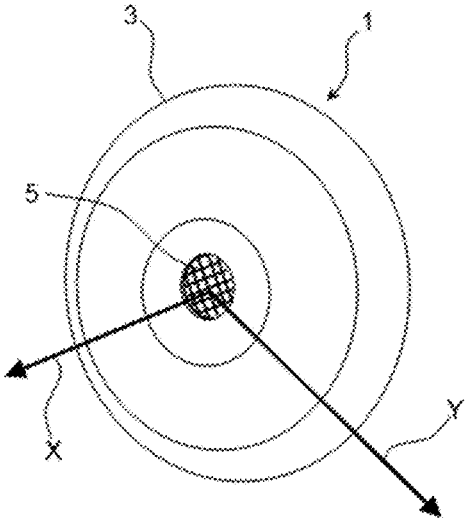
FIG. 2B shows a schematic perspective view of the earpiece shown in FIG. 2A, in a configuration in which the earpiece comprises a filter.

FIG. 2B illustrates a schematic perspective view of the earpiece 1 shown in FIG. 2A, in a configuration in which the earpiece 1 comprises a filter assembly. 5 attached to the front side of the earpiece 1. The filter assembly 5 comprises one or more filters configured to protect the speaker unit (not shown) attached to the adaptor 2 against ear wax and other unwanted particles. The earpiece 1 may comprise a filter attached to the surrounding part 3. The earpiece may further comprise a filter attached to the adaptor 2. Finally, a filter may be attached to the speaker unit.

FIG. 2B shows that the filter 5, basically, is formed as a circular grid-structure extending along the lateral axis Y and being perpendicular to the longitudinal axis X.

Figure 3:
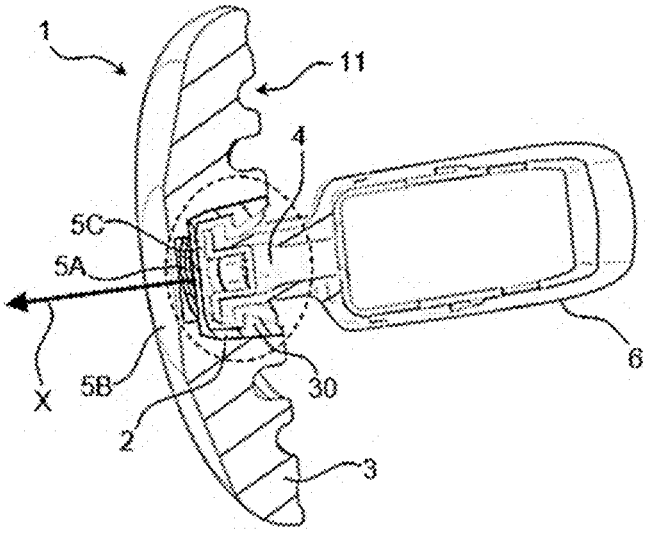
FIG. 3 shows a schematic cross-sectional view of an earpiece according to one embodiment of the disclosure, wherein a speaker unit is attached to the earpiece.

FIG. 3 illustrates a schematic cross-sectional view of an earpiece 1 according to one embodiment of the disclosure, wherein a speaker unit 4 of a receiver 6 is attached to the earpiece 1. The speaker unit 4 and the receiver 6 extend along the longitudinal axis X of the earpiece 1. The earpiece 1 comprises an adaptor 2 having an interface 30 adapted to lockingly receive the speaker unit 4. The interface 30 comprises a receiving structure protruding radially toward the longitudinal axis X of the earpiece 1. Hereby, the interface 30 comprises a receiving structure capable of receiving the speaker unit 4 and keep it fixed to the earpiece 1 once attached thereto.

The earpiece 1 is basically disc-shaped and comprises a foam part 3 surrounding the adaptor 2. The adaptable part 3 is compressible and adapted to be inserted into an ear canal in a manner in which it adapts to the shape of the ear canal.

The earpiece 1 comprises a filter assemble comprising a first filter 5B arranged to the adaptable part 3, a second filter 5A attached to the adaptor 2 and a third filter 5C attached to the speaker unit 4. The filter 5A is configured to reduce the amount of ear wax entering the speaker unit 4. Likewise, the filter 5B and the filter 5C, which substantially abuts the filter 5A of the adaptable part 3, are intended and constructed for reducing the amount of ear wax entering the adapter unit 4. Accordingly, the hearing aid comprises a 3-part filter protection system.

FIG. 3 shows that the interface 30 of the adaptor 2 is formed to fit the geometry of the speaker unit 4. The cross-sectional view of the interface 30 is substantially T-shaped and configured to receive and maintain the speaker unit 4 fixed to the adaptor 2. The interface 30 is configured and constructed to provide a locking and/or connection mechanism between the adaptor 2 and the speaker unit 4. Thus, it would be apparent for a person skilled in the art, that other shapes of the adaptor 2 would also work and fall within the scope of the disclosure. Thus, in an embodiment, the structure of the interface could be provided as an undercut of the adaptor 2 which is configured to connect with the speaker unit 4 in a manner in which the speaker unit 4 is mechanically fixed to the adaptor 2 of the earpiece 1. The backside of the adaptable part 3 is provided with structures 11 shaped as recesses.

Figure 4:
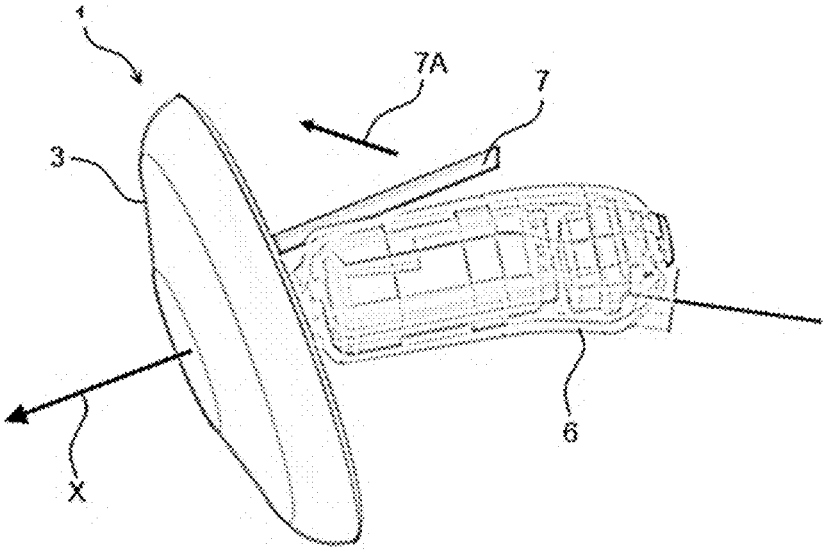
FIG. 4 shows a schematic perspective view of an earpiece according to an embodiment of the disclosure having a pull-off handle, wherein a speaker unit is attached to the earpiece.

FIG. 4 illustrates a schematic perspective view of an earpiece 1 according to an embodiment of the disclosure having a pull-off handle 7. The earpiece 1 is basically identical to the one shown in FIG. 3 except for the pull-off handle 7. A speaker unit of a receiver 6 is attached to the earpiece 1. The earpiece 1 comprises an adaptor surrounded by an adaptable part 3 (e.g. a foam part and a gel part). The pull-off handle 7 is configured and arranged to facilitate and hereby ease detachment of the adaptable part 3 from the receiver 6. The pull-off handle 7 makes it possible to attach the adaptable part 3 to the receiver 6 and to detach the adaptable part 3 from the receiver 6 without destroying the adaptable part 3, which may be vulnerable. The adaptable part 3 can be attached or replaced by pulling the pull-off handle 7 in a direction along the indicated arrow 7A.

Figure 7A:
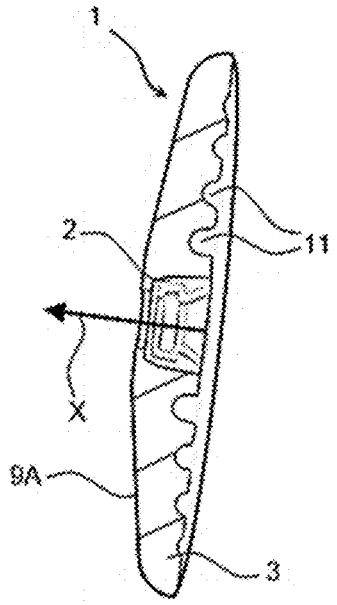
FIG. 7A shows a schematic cross-sectional view of an earpiece according to an embodiment of the disclosure.
Figure 7B:
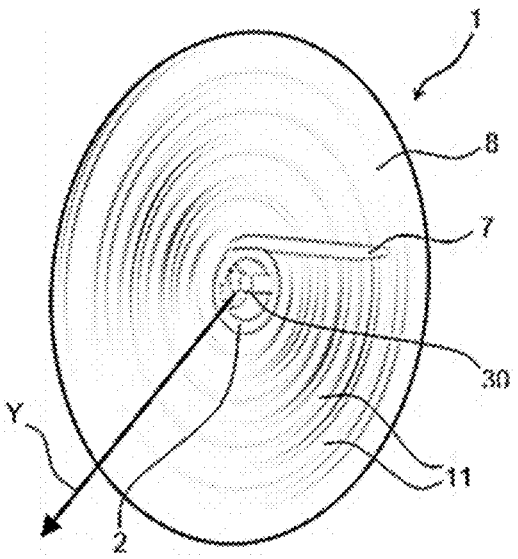
FIG. 7B shows a schematic perspective view of an earpiece according to another embodiment of the disclosure.

As indicated in FIG. 7B, the pull-off handle 7 is attached to the adaptor and extends in a direction basically parallel to the longitudinal axis X of the earpiece 1. Accordingly, when inserted into an ear canal, the pull-off handle protrudes from the adaptor along the length of the ear canal and extends from the proximal (back side) end of the earpiece 1, facing the exterior (i.e. the pinna).

Figure 5:
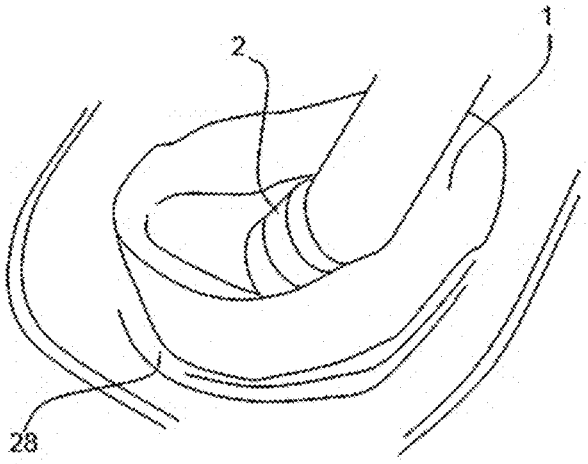
FIG. 5 shows a schematic view of an earpiece according to an embodiment of the disclosure arranged in a 3D-printed ear canal.

FIG. 5 illustrates a schematic perspective top view of an earpiece 1 according to an embodiment of the disclosure arranged in a 3D-printed ear canal 28. The earpiece 1 is basically disc-shaped and has been inserted into the ear canal 28. Since the earpiece 1 comprises a centrally arranged adaptor 2 and a compressible adaptable part surrounding the adaptor 2, the earpiece 1 is capable of adapting to the inner geometry of the ear canal 28. As illustrated in FIG. 5, the earpiece 1 has adapted to the inner geometry of the ear canal 28. Accordingly, the earpiece 1 is capable of providing a good and tight sealing against the inner wall of the ear canal 28. It may be an advantage to apply a basically disc-shaped earpiece 1 comprising an adaptor 2 surrounded by an adaptable part made in a foam material or a gel.

Figure 6A:
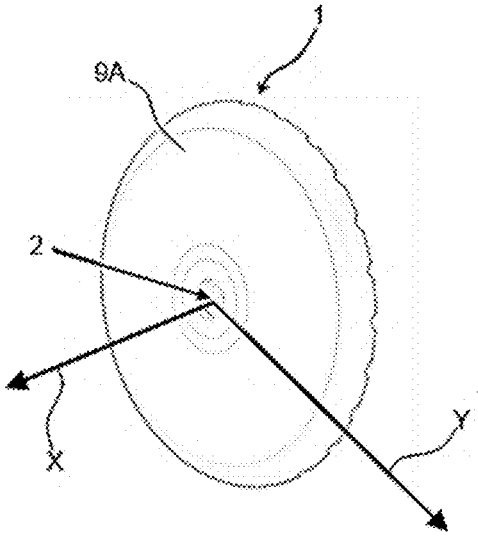
FIG. 6A shows a schematic perspective view of an earpiece according to an embodiment of the disclosure.
Figure 6B:
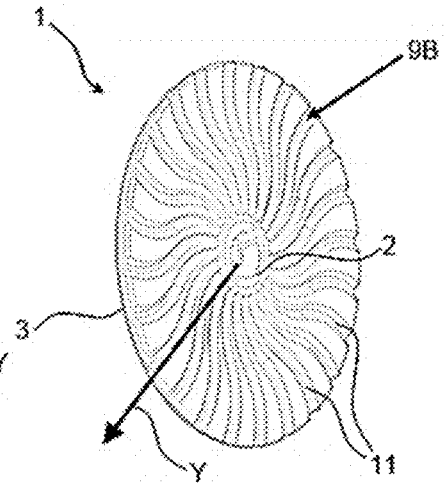
FIG. 6B shows another schematic perspective view of the earpiece shown in FIG. 6A.

FIG. 6A illustrates a schematic perspective front view of an earpiece 1 according to an embodiment of the disclosure, whereas FIG. 6B illustrates a schematic perspective rear view of the earpiece 1 shown in FIG. 6A. The earpiece 1 has a longitudinal axis X and a lateral axis Y. The earpiece 1 is basically disc-shaped and comprises a centrally arranged adaptor 2 surrounded by an adaptable part 3. The adaptor 2 and the adaptable part 3 are shaped as a single one-piece body, preferably made by using injection moulding. The earpiece 1 comprises a first surface 9A (the front surface) and a second surface 9B (the back side surface).

The back side of the earpiece 1 is provided with a structured surface comprising a plurality of bended recesses 8. The recesses 11 are arranged symmetrically with respect to the longitudinal axis X of the earpiece 1. The bended recesses 11 extend basically radially between the adaptor 2 and the outer periphery of the earpiece 1.

The first surface 9A is intended to be arranged in a manner in which it faces the eardrum, whereas the second surface 9B is intended to be arranged in the ear canal while being directed towards the outer ear.

The structures 11 of the second surface 9B are configured to make it easier to collapse the earpiece 1 without folding the earpiece 1, i.e. avoiding folding of the earpiece 1. Hereby, leakages between the inner wall of the ear canal and the earpiece 1 can be avoided.

During insertion of the earpiece 1 into the ear canal, when the first surface 9A is brought into contact with the inner wall of the ear canal, the second surface 9B starts to fold if the cross-sectional area of the earpiece 1 exceeds the cross-sectional area of the ear canal. The structures 11 provided on the second surface 9B enable the first surface 9A to adapt to the geometry of the ear canal.

The structured surface 9B comprises a plurality of curved track-shaped recesses 11 uniformly distributed along the surface 9B. Accordingly, the earpiece 1 is has rotational symmetry with respect to rotations about its longitudinal axis X. The recesses 11 extend basically radially from the periphery of the adaptor 2 to the periphery (circumferential part) of the earpiece 1.

The thickness of the curved recesses 11 may be constant or vary radially. It can be seen that the curved recesses 11 are basically S-shaped. The distance between adjacent recesses 11 at the circumferential part of the earpiece 1 may be within a range of 0.2 mm to 3.5 mm, 0.69 mm to 3.5 mm, 1 mm to 3.5 mm, 0.2 mm to 2.5 mm, 0.2 mm to 1.5 mm, 0.5 mm to 1 mm or 0.7 mm to 1.5 mm.

FIG. 7A illustrates a schematic cross-sectional view of an earpiece 1 according to an embodiment of the disclosure. The earpiece 1 corresponds to the one shown in FIG. 6A and in 6B expect for the shape of the structured surface 8 (provided with recesses 11). The earpiece 1 is basically disc-shaped and is provided with a front surface 9A and a structured back surface 8 on the second surface 9B with structures 8 provided as circular recesses 11. The recesses 11 are shaped and configured to facilitate and hereby make it easier to collapse the adaptable part 3 of the earpiece 1 radially (perpendicular to the longitudinal axis X).

The structured surface 8 comprises a plurality of concentrically arranged recesses 11 provided in circular configurations. The recesses 11 are radially displaced relative to each other in such a manner that the innermost recess 11 has the smallest diameter and that the diameter of the remaining recesses gradually increased towards the periphery of the earpiece 1.

The distribution of the rings on the structured surface may be uniform. However, as seen in FIG. 7A, the thickness of the recesses 11 gradually decreased towards the periphery of the earpiece 1. Accordingly, the innermost recess 11 is the thickest recess and the outermost recess is the thinnest. The diameter of the ring-shaped recesses may vary within a range of 2 mm to 8 mm, 2 mm to 17 mm, 2 mm to 20 mm, 1 mm to 8 mm, 1 mm to 17 mm, 2 mm to 7 mm or 0.5 mm to 17 mm.

The earpiece comprises a centrally arranged adaptor 2 surrounded by the adaptable part 3.

FIG. 7B illustrates a schematic perspective view of an earpiece 1 according to another embodiment of the disclosure. The earpiece 1 basically corresponds to the earpiece 1 shown in FIG. 7A, however, the earpiece 1 shown in FIG. 7B comprises a pull-off handle 7 extending parallel to the longitudinal axis of the earpiece 1 and perpendicular to the lateral axis Y of the earpiece 1.

It can be seen that the structured surface 8 of the earpiece 1 comprises a plurality of concentrically arranged recesses 11 of circular geometry and that the recesses 11 are radially displaced relative to each other. The adaptor 2 of the earpiece 1 comprises an interface 30 configured to receive a speaker unit (not shown) and maintain the speaker unit attached to the adaptor 2.

Figure 8:
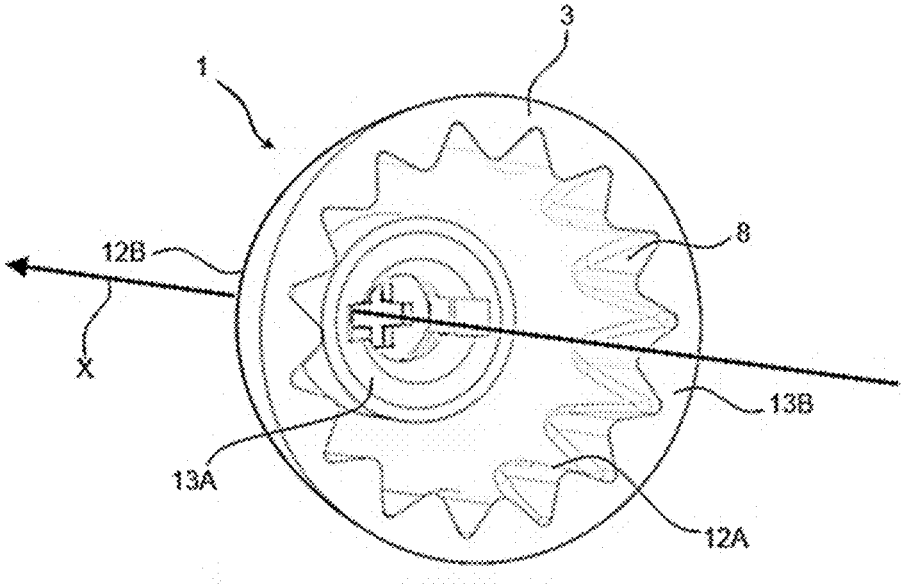
FIG. 8 shows a schematic perspective view of an earpiece according to an embodiment of the disclosure.

FIG. 8 illustrates a schematic perspective back side view of an earpiece 1 according to an embodiment of the disclosure. The earpiece 1 is basically dome-shaped and comprises a surface provided with a plurality of structures 8 configured to ease collapsing of the earpiece 1. Due to the uniformly distribution of the structures 8, the earpiece 1 has a uniformly distributed folding ability.

The earpiece 1 is provided with an inner surface 12A and an outer surface 12B, wherein the outer surface 12B is intended to be directed towards the inner wall of an ear canal and wherein the inner surface 12A is directed radially inwardly. The inner surface 12A is provided with structures 8 for improving the folding ability of the earpiece 1. Accordingly, the earpiece 1 can be folded without creating any leakage between the inner wall of the ear canal and the earpiece 1. The structures 8 are formed as grooves having a constant or uniformly distributed cross-sectional area. The cross-section of the grooves may have any suitable form. The cross-section of the grooves shown in FIG. 8 is basically triangular.

The earpiece 1 is provided with a first end surface 13A and a second end surface 13B. The first end surface 13A is configured to be directed towards the eardrum, whereas the second end surface 13B is intended to be directed towards the opening of the ear canal, when the earpiece 1 is arranged in the ear canal. The grooves extend basically along the longitudinal axis X of the earpiece 1.

Figure 9A:
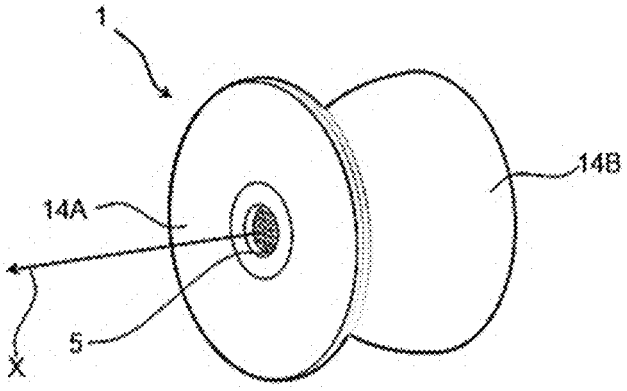
FIG. 9A shows a schematic perspective front-side view of an earpiece according to an embodiment of the disclosure.
Figure 9B:
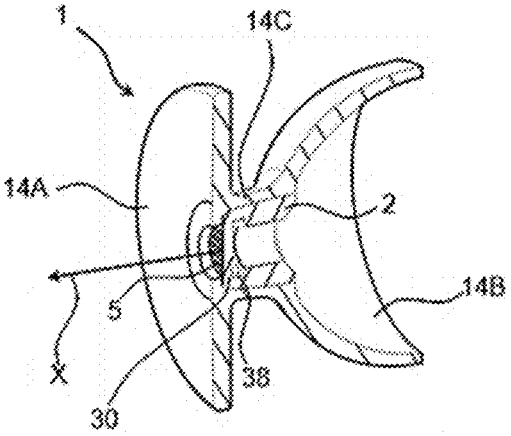
FIG. 9B shows a schematic perspective cross-sectional view of the earpiece shown in FIG. 9A.
Figure 9C:
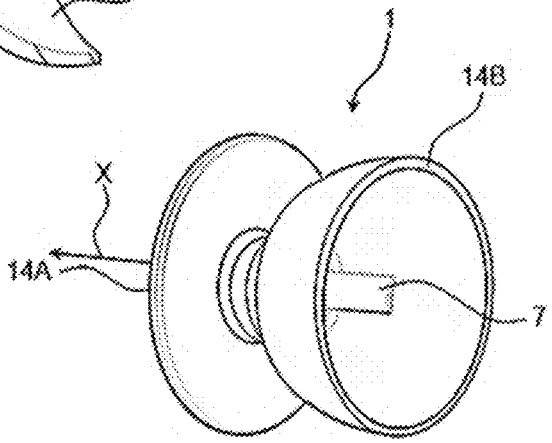
FIG. 9C shows a schematic perspective back-side view of an earpiece according to an embodiment of the disclosure.

FIG. 9A illustrates a schematic perspective view of an earpiece 1 according to an embodiment of the disclosure, whereas FIG. 9B shows a schematic perspective cross-sectional view of the earpiece shown in FIG. 9A. FIG. 9C illustrates a schematic perspective back-side view of the earpiece 1 shown in FIG. 9A and FIG. 9B.

The earpiece 1 comprises a first basically disc-shaped part 14A, a second basically dome-shaped part 14B and an intermediate part 14C extending between the first part 14A and the second part 14B.

A centrally arranged adaptor 2 is attached to the first part 14A. The adaptor 2, however, extends along the length of the intermediate part 14C. The second part 14B comprises a pull-off handle 7 extending along the longitudinal axis X of the earpiece 1.

The first part 14A, the second part 14B and the intersection part 14C may be molded to form a single one-piece body in one or more materials. The adaptor 2 comprises an interface 30 provided with a groove portion 38 configured to receive a speaker unit and keep it attached to the adaptor 2. A filter 5 is attached to the front portion of the adaptor 2.

Figure 10A:
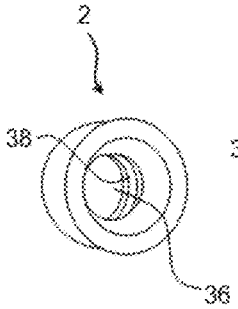
FIG. 10A shows a schematic perspective view of an adaptor according to an embodiment of the disclosure.
Figure 10B:
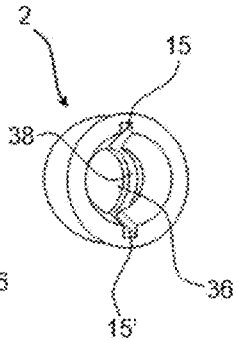
FIG. 10B shows a schematic perspective view of another adaptor according to an embodiment of the disclosure.
Figure 10C:
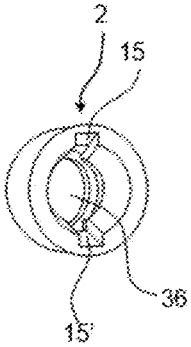
FIG. 10C shows a schematic perspective view of a further adaptor according to an embodiment of the disclosure.

FIG. 10A illustrates a schematic perspective view of an adaptor 2 according to an embodiment of the disclosure. FIG. 10B illustrates a schematic perspective view of another adaptor 2 according to an embodiment of the disclosure. FIG. 10C illustrates a schematic perspective view of a further adaptor 2 according to an embodiment of the disclosure and FIG. 10D illustrates a schematic perspective view of an even further adaptor 2 according to an embodiment of the disclosure.

The adaptors 2 have a basically cylindrical outer geometry and are provided with a centrally arranged sound outlet channel 36. Each adaptor 2 is provided with a groove portion 38 configured to receive a speaker unit (not shown) and maintain the speaker unit attached to the adaptor 2.

Figure 10D:
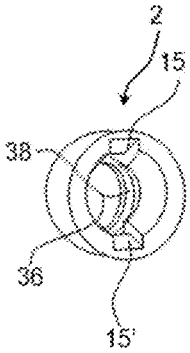
FIG. 10D shows a schematic perspective view of an even further adaptor according to an embodiment of the disclosure

Each of the adaptors shown in FIG. 10B, FIG. 10C and in FIG. 10D comprise two narrow vents 15, 15' provided in opposing areas of the adaptors 2. The vents 15, 15' extend along the length of the adaptors 2 and have a basically rectangular cross-section. The adaptor 2 shown in FIG. 10B is provided with narrow vents 15, 15'. The adaptor 2 shown in FIG. 10C is provided with slightly broader vents 15, 15' than the adaptor shown in FIG. 10B, whereas the adaptor 2 shown in FIG. 10D is provided with slightly broader vents 15, 15' than the adaptor shown in FIG. 10C. FIG. 10B, FIG. 10C and FIG. 10D illustrate that vents 15, 15' of different geometry can be incorporated in an adaptor 2 according to the disclosure. In one embodiment of an earpiece according to the disclosure, one part of the vents 15, 15' are provided in the adaptor, wherein another part of the vents 15, 15' are provided in the outer surface of the speaker unit.

Figure 11A:
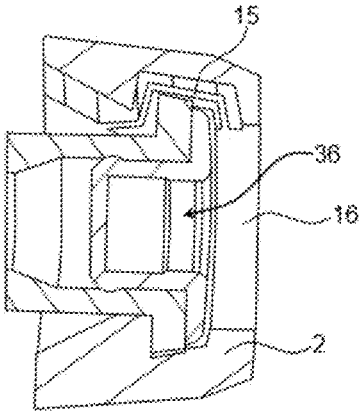
FIG. 11A shows a schematic cross-sectional view of an adaptor according to an embodiment of the disclosure.
Figure 11B:
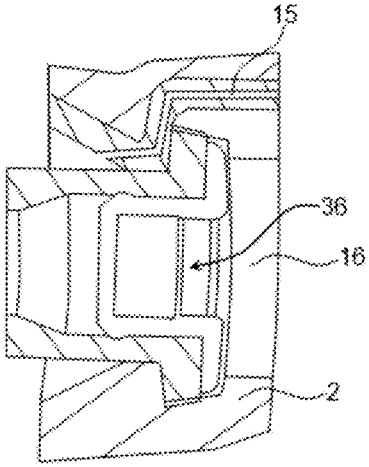
FIG. 11B shows a schematic perspective view of another adaptor according to an embodiment of the disclosure.

FIG. 11A illustrates a schematic cross-sectional view of an adaptor 2 according to an embodiment of the disclosure, whereas FIG. 11B illustrates a schematic perspective view of another adaptor 2 according to an embodiment of the disclosure.

The adapter 2 shown in FIG. 11A comprises a vent 15 coupled to the receiver output 16. Accordingly, the vent 15 is in fluid communication with the receiver output 16 and thus the sound outlet channel 36.

The adapter 2 shown in FIG. 11B is provided with a vent 15 that is decoupled from the receiver output 16 and the sound outlet channel 36. Accordingly, the vent 15 is not in fluid communication with the receiver output 16 and thus the sound outlet channel 36.

FIG. 12A illustrates a schematic view of an earpiece 1 according to an embodiment of the disclosure. FIG. 12B illustrates an end view of the earpiece 1 shown in FIG. 12A and a close-up view of the structure of the earpiece, whereas FIG. 12C illustrates a close-up view of the outside surface of the earpiece 1 shown in FIG. 12A.

FIG. 12A, FIG. 12B and FIG. 12C illustrate examples of a foam material with an open cell structure and a closed cell structure. FIG. 12A shows an earplug 1 (an example of an earpiece 1 according to the disclosure). FIG. 12B shows an open cell structure 24 and FIG. 12C shows a semi-closed cell structure 26 of the earplug shown in FIG. 12A. The semi-closed cell structure 26 is provided at the outer curved surface of the earplug 1, whereas the open cell structure 24 is provided in the end region of the earplug 1.

FIG. 13 illustrates a schematic side view of an earpiece 1 according to an embodiment of the disclosure. The earpiece 1 is provided with an outer side 18 provided with a coated surface 17. The outer side 18 of the earpiece 1 can be made either as an open cell structure or as a closed cell structure according to the embodiment as explained with reference to FIG. 12A, FIG. 12B and FIG. 12C. The earpiece 1 comprises an adaptable part 3. This adaptable part 3 needs to be open in some areas in order to let the air out of the cells after being compressed. A closed cell structure provided by the coated surface 17 may be advantageous because it prolongs the durability of the earpiece 1.

Since a closed cell structure prevents dirt and earwax to enter the earpiece, an outer side 18 provided with a closed cell structure may be beneficial. Moreover, an outer side 18 provided with a closed cell structure is easier to clean e.g. by wiping. Accordingly, a closed cell structure is desirable at the outer side 18 of the earpiece 1, since this part of the earpiece 1 is in contact with the ear canal or handled by fingers.

Figure 14:
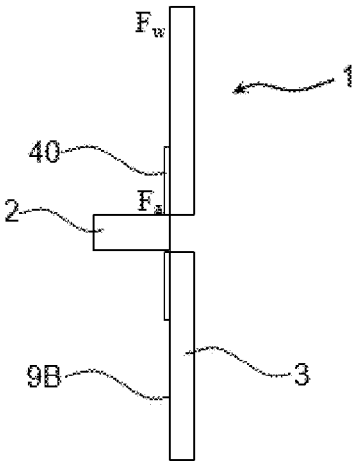
FIG. 14 shows a schematic side view of an earpiece according to an embodiment of the disclosure.

FIG. 14 illustrates a schematic side view of an earpiece 1 according to an embodiment of the disclosure. The earpiece 1 comprises a centrally arranged adaptor 2 and an adaptable part 3 extending radially in extension of the adaptor 2. The adaptor 2 is arranged substantially on one side 9B (e.g. the side intended to face towards the pinna) of the earpiece 1.

The adaptor 2 is provided with a flange part 40 extending radially from a tubular portion of the adaptor 2. The flange 40 extends along the central portion of the adaptable part 3. Accordingly, the adaptor 2 is attached to the adaptable part 3 by means of the flange 40.

Figure 15:
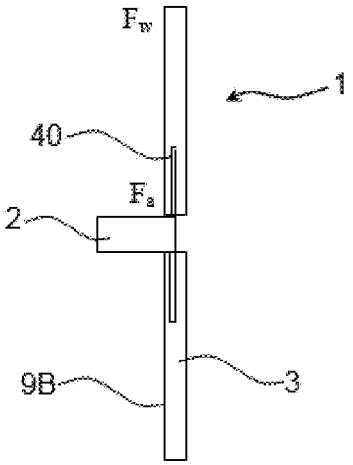
FIG. 15 shows a schematic side view of another earpiece according to an embodiment of the disclosure.

FIG. 15 illustrates a schematic side view of another earpiece 1 according to an embodiment of the disclosure. The earpiece 1 shown in FIG. 15 almost corresponds to the one shown in FIG. 14. The flange 40 of the adaptor 2, however, is arranged within the adaptable part 3. The flange 40 of the adaptor 2 can be attached to a groove in the adaptable part 3 or be moulded into the material of the adaptable part 3.

Both in FIG. 14 and in FIG. 15, the flanges may be constructed in such a manner that the flexibility of the earpiece varies along the width of the earpiece 1. The flange 40 and/or the adaptor 2 may be made in a material being less flexible than the adaptable part 3. Hereby, the earpiece 1 will be less flexible at the central region, at which the adaptor 2 is attached, than at the peripheral portion of the earpiece 1. As indicated in FIG. 14, the flexibility $F_a$ in the central region of the earpiece 1, at which the adaptor 2 is attached, is larger than the flexibility $F_w$ at the peripheral portion of the earpiece 1.

Accordingly, in an embodiment of the earpiece 1 according to the disclosure, the adaptor 2 and earpiece 1 may be have a first flexibility, $F_a$, at the central region of the earpiece 1 and have a second larger flexibility, $F_w$, at the peripheral portion of the earpiece 1. Hereby, it is possible to provide an earpiece 1 that is resilient and capable of adapting to the geometry of an ear canal when inserted therein.

Put in other words, by producing an earpiece 1 having a flexibility configuration fulfilling the relation:

(1) $F_a<F_w$, where $F_a$ is the flexibility at the central portion of the earpiece 1, wherein $F_w$ is the flexibility of the earpiece 1 at its peripheral portion, the earpiece 1 capable of being compressed during insertion into an ear canal. Furthermore, the earpiece 1 may have sufficient resistance to avoid collapse of the adaptor 2 and earpiece 1 upon insertion into the ear canal of a user.

Additionally, the flange 40 of the adaptor 2 prevents detachment of the adaptor 2 from the earpiece 1 upon insertion and/or removal, due to the larger surface area of the flange 40.

Furthermore, the flange 40 and/or the adaptable part 3 bearing against the flange 40 may be coating with an adhesive material in order to provide an improved attachment between the adaptor 2 and the adaptable part 3. Using a flange construction as illustrated in FIG. 14 and in FIG. 15 provides a secure way of attaching the adaptor 2 to the adaptable part 3 and an efficient way to prevent the earpiece 1 from collapsing during insertion into an ear canal.

Figure 16:
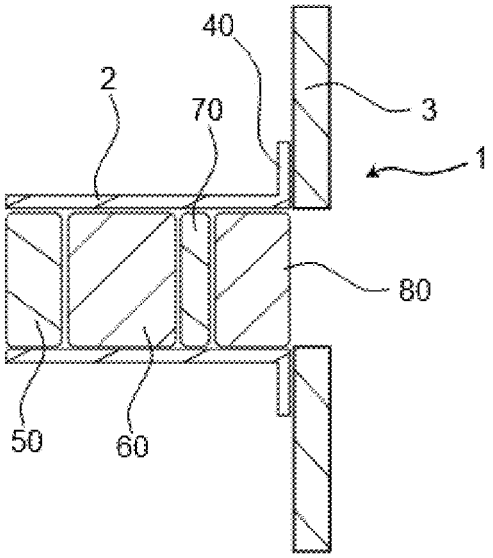
FIG. 16 shows a schematic side view of an earpiece according to an embodiment of the disclosure.
Figure 17:
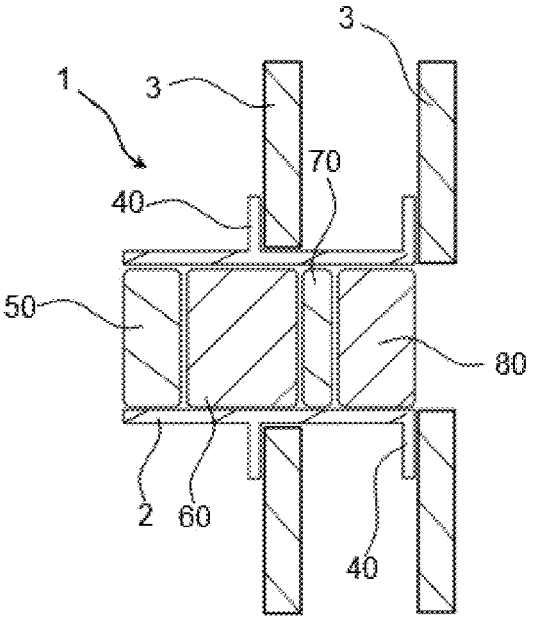
FIG. 17 shows a schematic side view of another earpiece according to an embodiment of the disclosure.

FIG. 16 illustrates a schematic side view of an earpiece 1 according to an embodiment of the disclosure, and FIG. 17 illustrates a schematic side view of another earpiece 1 according to an embodiment of the disclosure.

The earpiece 1 illustrated in FIG. 16 and in FIG. 17 comprises an adaptor 2 having an acoustic assembly and a battery arranged in the adaptor 2. The adaptor 2 comprises a microphone 50, a battery 60, an amplifier 70 and a receiver 80. The arrangement of the microphone 50, battery 60, amplifier 70 and receiver 80 may be arranged differently than shown in FIG. 16 and FIG. 17.

The adaptor 2 is attached to an adaptable part(s) 3 of the earpiece 1. The adaptor 2 may be attached to the adaptable part(s) 3 by any suitable means e.g. during a moulding process, by mean of glue or by means of any suitable mechanical attachment method. The adaptor 2 in FIG. 16 is provided with a single flange 40 extending perpendicular to the longitudinal axis of the adaptor 2. The adaptor 2 in FIG. 17 is provided with two parallel sets of flanges 40 extending perpendicular to the longitudinal axis of the adaptor 2.

The adaptable part(s) 3 of the earpiece 1 is disc-shaped and configured to adapt to the geometry of the inner wall of the ear canal of a hearing aid user. The earpiece 1 and the corresponding acoustic elements and the battery are intended for being used as an in-the-canal hearing aid solution. Thus, the disc shaped earpiece solution can be applied deep in the ear, and potentially used in a hearing aid intended to be invisible in the ear and is arranged in the bony region of the ear canal.

FIG. 18 illustrates a schematic cross-sectional view of an earpiece 1 according to an embodiment of the disclosure. The earpiece 1 illustrates an example of an injection moulded component.

The earpiece 1 comprises a centrally arranged adaptor 2 attached to a surrounding adaptable part 3. A first vent 15 and a second vent 15' are provided in the adaptor 2. The vents 15, 15' are, however, closed by membranes 114, 114', 116 covering the first vent 15, the second vent 15' and the sound outlet channel 36, respectively. Before the earpiece 1 is ready to be used, the membranes 114, 114', 116 must be removed.

FIG. 19A illustrates a schematic top view of an earpiece 1 according to an embodiment of the disclosure. The earpiece 1 comprises a centrally arranged sound outlet channel 36.

FIG. 19B illustrates a schematic top view of an earpiece 1 according to another embodiment of the disclosure. The earpiece 1 comprises a centrally arranged sound outlet channel 36 and a vent 15 having a vent outlet arranged next to the sound outlet channel 36.

FIG. 19C illustrates a schematic top view of an earpiece 1 according to a further embodiment of the disclosure. The earpiece 1 comprises a centrally arranged sound outlet channel 36 and a first vent 15 having a vent outlet arranged next to the sound outlet channel 36 and a second vent 15' having a vent outlet arranged next to the sound outlet channel 36 at the opposite side of the sound outlet channel 36.

FIG. 19D illustrates a schematic top view of an earpiece 1 according to an even further embodiment of the disclosure. The earpiece 1 comprises a centrally arranged sound outlet channel 36 and four vents 15, 15', 15'', 15''' each having a vent outlet arranged next to the sound outlet channel 36. The vent outlets are provided in a square configuration surrounding the sound outlet channel 36.

FIG. 20A illustrates a perspective view of an earpiece 1 according to an embodiment of the disclosure being compressed by the hand 32 of a user. The directions of the forces applied to compress the earpiece 1 are indicated with arrows.

FIG. 20B shows a perspective view of the earpiece 1 shown in FIG. 20A arranged in the ear canal of a user, and FIG. 20C illustrates a perspective view of how the earpiece 1 shown in FIG. 20B expands radially while being arranged in the ear canal. The direction of the expansions are illustrated with arrows. A receiver is attached to the earpiece 1 in both FIG. 20A, FIG. 20B and FIG. 20C.

Figure 21:
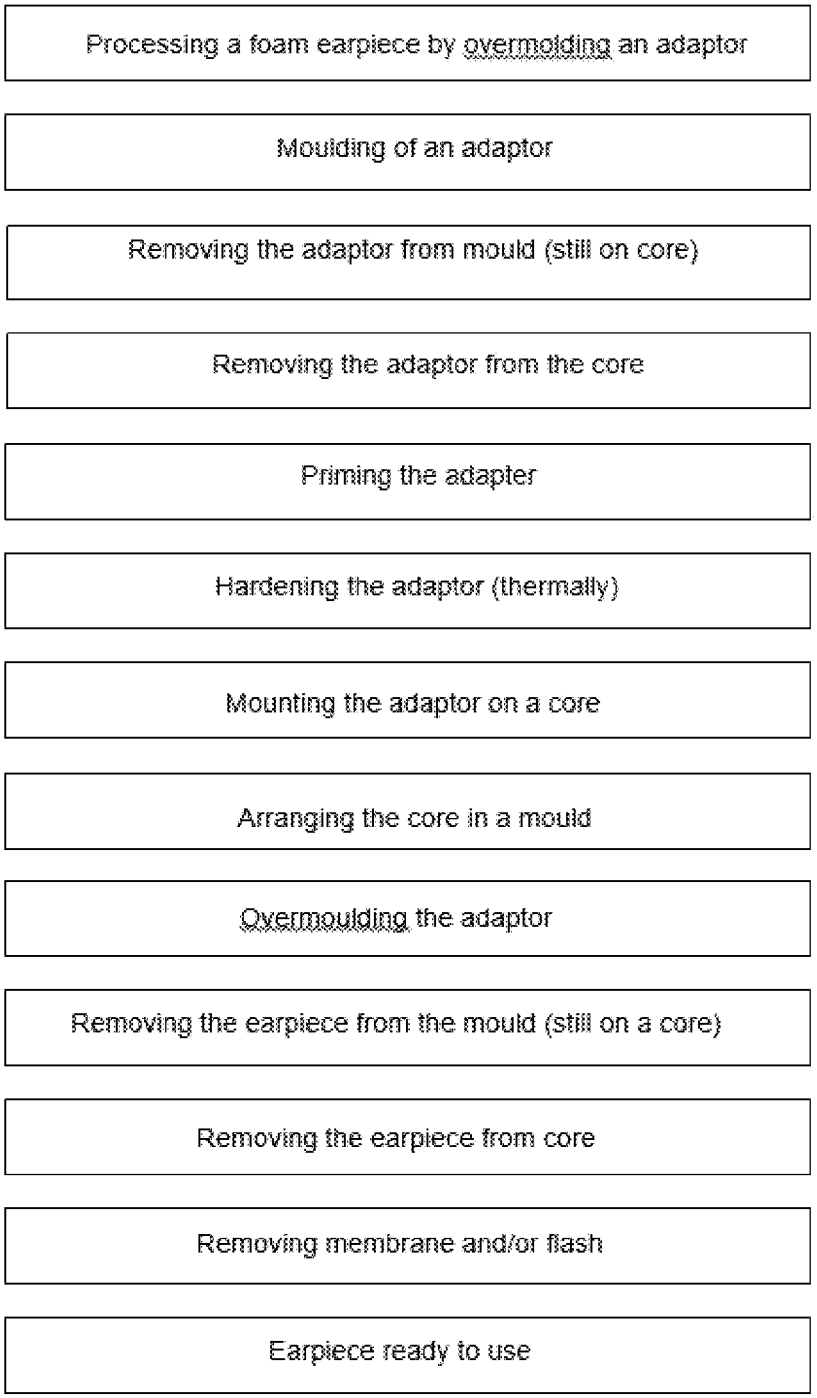
FIG. 21 shows a list of sequences involved in a method according to the disclosure.

FIG. 21 is a list of sequences involved in a method according to the disclosure.

Figure 22:
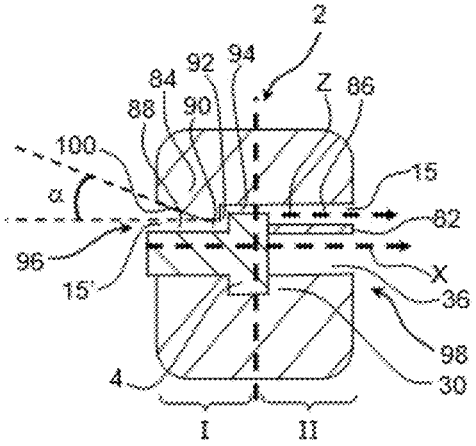
FIG. 22 shows a schematic cross-sectional view of an adaptor according to an embodiment of the disclosure.

FIG. 22 illustrates a schematic cross-sectional view of an adaptor 2 according to an embodiment of the disclosure. The adaptor 2 comprises a centrally arranged sound outlet channel 36 extending along the longitudinal axis X of the adaptor 2. A basically T-shaped speaker unit 4 has been attached to an interface 30 of the adaptor 2. The interface 30 is configured and shaped to lockingly receive the speaker unit 4 and fix the speaker unit to the adaptor 2.

A vent 15, 15' comprising a first vent portion 15 and a second vent portion 15' is provided in the adaptor 2. The first vent portion 15 extends parallel to the outlet channel 36 and thus to the longitudinal axis X. A barrier structure 82 is arranged to separate the first vent portion 15 from the outlet channel 36. The first vent portion 15 extends along a longitudinal axis Z parallel to the longitudinal axis of the adaptor 2.

The adaptor comprises a first portion I and a second portion II indicated in FIG. 22. It can be seen that the barrier structure 82 surrounds the sound outlet channel 86 extending in the second portion II. The barrier structure 82 makes it possible to provide an earpiece that reduces the acoustic feedback in a simple manner.

The barrier structure 82 may be produced in the same material as the surrounding portions of the adaptor 2. The cross-section of the first vent portion 15 may be circular, oval, polygonal, triangular, rectangular, square, pentagonal, hexagonal, octagonal or have any other suitable shape.

The adaptor comprises a snout element 84 provided in the first portion I of the adaptor 2 and that the barrier structure 82 is provided in a different (second portion II) portion of the adaptor 2.

The adaptor 2 comprises a first end 96 and a second end 98. The snout element 84 comprises a structure 100 inclined (an angle $\alpha$) relative to the longitudinal axis X of the adaptor 2. The cross-sectional area of the second vent portion 15' gradually increases towards the first end 96. Accordingly, an efficient venting can be provided by means of the second vent portion 15'. The vent portions 15, 15' of the adaptor 2 comprises a plurality of sections 86, 88, 90, 92, 94 which will be explained further with reference to FIG. 24.

Figure 23:
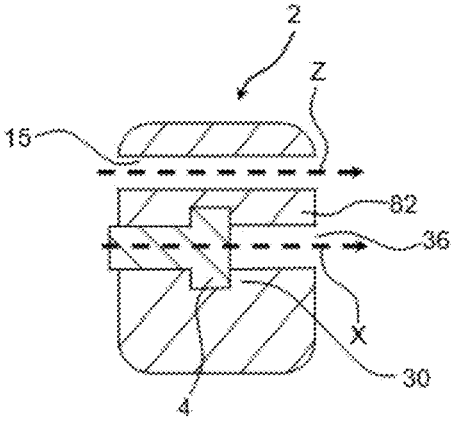
FIG. 23 shows a schematic cross-sectional view of an adaptor according to another embodiment of the disclosure and FIG. 24 shows a close-up view of the central structure of the adaptor shown in FIG. 22.

FIG. 23 illustrates a schematic cross-sectional view of an adaptor 2 according to another embodiment of the disclosure. The adaptor 2 comprises a centrally arranged sound outlet channel 36 extending along a longitudinal axis X of the adaptor 2. A basically T-shaped speaker unit 4 has been inserted and hereby fixed to an interface 30 of the adaptor 2. The interface 30 is adapted and formed to lockingly receive the speaker unit 4 and keep it in a fixed position.

A vent 15 is provided in the adaptor 2. The vent 15 extends along its longitudinal axis Z that extends parallel to the outlet channel 36 and thus to the longitudinal axis X of the adaptor 2. A barrier structure 82 is arranged to separate the vent 15 from the outlet channel 36.

Figure 24:
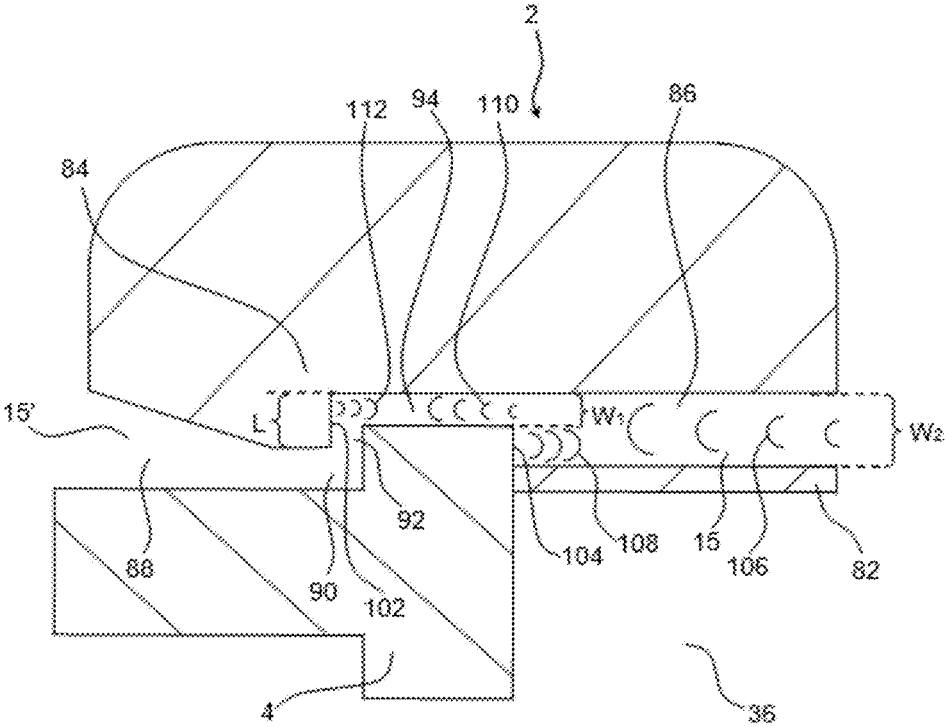

FIG. 24 illustrates a close-up view of the central structure of the adaptor 2 shown in FIG. 22. The adaptor 2 comprises a barrier structure 82 arranged to separate the first vent portion 15 from the outlet channel 36. The first vent portion 15 extends along a longitudinal axis parallel to the longitudinal axis of the adaptor. The first vent portion 15 comprises a section 94 having a first width $W_1$ that is smaller than the width $W_2$ of the distal section 86 of the first vent portion 15.

The speaker unit 4 comprises a structure having a surface 104 extending into the first vent portion 15 and hereby creating a narrowing section 94. Accordingly, a large portion of the sound waves 106 reflected from the ear drum entering the first vent portion 15 will be reflected by the surface 104. Some sound waves 110 will, however, be transferred through the narrowing section 94. The snout element 84 comprises a wall structure having a surface 102 extending perpendicular to the length of the narrowing section 94. The surface 102 receives the sound waves 110, which are reflected as sound waves 112. Accordingly, the vent structures 15, 15' are configured to minimise acoustic feedback. Due to the increasing cross-sectional area of the second vent portion 15' (the section 90 and 88) towards its opening, the vent portion 15' effectively ventilates the adaptor 2. Hereby, the snout element 84 allows for an effective venting of the adaptor 2, hereby reducing or even eliminating the occlusion effect.

The vent portion 15' is connected to the first vent portion 15 by the sections 92, 94. The section 94 has a smaller cross-sectional area than the first vent portion 15. The section 94 extends basically perpendicular to the longitudinal axis of the first vent portion 15. The length L of the section 92 exceeds the width $W_1$ of the section 94. Accordingly, it is possible to reflect the sound waves 110 in order to provide an effective feedback cancellation.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method are not limited to the exact order stated herein, unless expressly stated otherwise.

Figure 25:
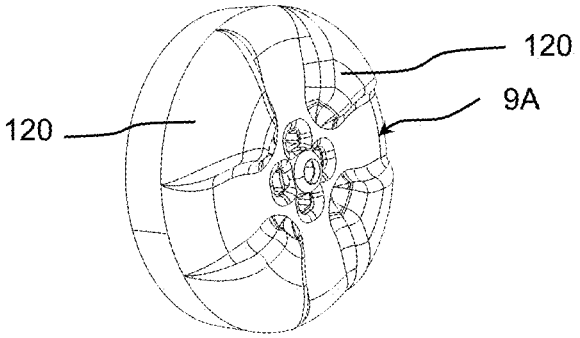
FIG. 25 show a front side of the earpiece according to an embodiment of the disclosure.

In yet another embodiment, which could be combined with embodiments of the previous descriptions, the earpiece 1, comprises a series of equally distributed raisings 120 in the material of the front side 9A of the earpiece as seen on FIG. 25. Such raisings 120 are preferably forming part of the earpiece so as to allow aid in avoiding collaps of the ear piece when inserted into the ear canal of a user. A collapse can cause the sound outlet or the ventilation holes to close, which makes the hearing aid partly dysfunctional, which the raisings 120 of this embodiment aims at avoiding to provide a more efficient hearing aid over time. The raisings 120 are shown to be equally distributed on the surface, however, it should be contemplated that other distributions would be conceivable.

Figure 26:
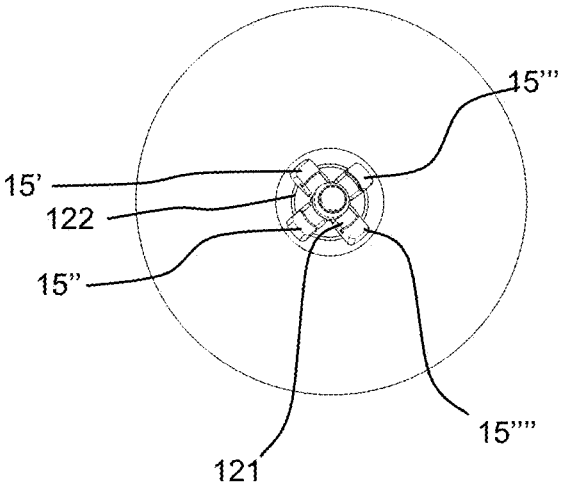
FIG. 26 show a back side of the earpiece according to an embodiment of the disclosure, wherein an adaptor structure is illustrated, and FIG. 27 show a cross-sectional view of the embodiment of FIGS. 25 and 26.

In addition, the back side 9B of the earpiece 1, may furthermore comprise an adaptor having the structure as illustrated in FIG. 26. In this embodiment, each of the vent channels 15', 15", 15''', 15'''' are incorporated in the adaptor in a manner in which a barrier part 121 forms a ring structure inside the adaptor, the ring structure separating the vent channels from each other and allowing for a more sufficient an tight connection the receiver attached to the earpiece.

Figure 27:
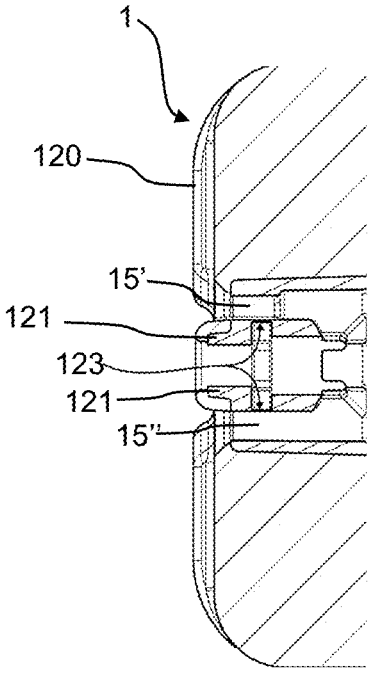

Illustrated in FIG. 27 is the earpiece according to at least FIGS. 25 and 26 shown in a cross-sectional view. The earpiece 1 illustrates how the barrier part 121 forms a ring structure inside the earpiece. Accordingly, parts 121 of the ring structure is shown in a cross-section, and it should be understood that the ring is a closed ring structure. Accordingly, the ring structure 121 is extending inside a piece of material 122 of the of the earpiece 1. That is the ring part assist in separating the vent channels 15', 15", 15''', 15'''' from the opening of the adaptor in which the receiver is inserted during use. The arrows in FIG. 27 indicates flashes (substantially an inner channel) 123 of the ring structure, which inner channels 123 forms a small air connection between the vent channel 15 and the receiver, when the receiver is inserted into the earpiece 1. It should be noted that the "flashes" and as such the air connection between the vent channels and the receiver could be left out.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but are to be accorded the full scope consistent with the language of the claims, wherein reference to an element in the singular is not intended to mean "one and only one" unless specifically stated, but rather "one or more." Unless specifically stated otherwise, the term "some" refers to one or more.

Accordingly, the scope should be judged in terms of the claims that follow.

The invention claimed is:

1. An earpiece configured to be worn in an ear canal of a user, the earpiece comprising:

an adaptor having a locking interface configured to receive at least a part of a speaker unit and lock the adaptor to the speaker unit, an adaptable part, made of a foam material or a gel material shapeable to fit the ear canal of the user, wherein the adaptable part at least partly surrounds the adaptor, and the adaptor comprises a sound outlet channel and at least one vent, wherein the at least one vent is separated from the sound outlet channel when the speaker unit is attached to the earpiece, the at least one vent is separated from the sound outlet channel by a barrier structure, wherein the barrier structure at least partly surrounds the sound outlet channel, the vent comprises a first section and a second section connected to the first section by one or more additional sections, wherein the first section is connected to the end of the earpiece that is intended to face the eardrum when inserted into the ear canal, wherein the second section is connected to the opposite end of the earpiece, wherein at least the distal portion of the second section has a larger cross-sectional area than the first section, and the second section is connected to the first section by an additional section comprising:

a first structure having a smaller cross-sectional area than the first section, and a second structure extending basically perpendicular to the longitudinal axis of the first section of the vent and to the longitudinal axis of the first structure, wherein the length of the second structure exceeds the width of the first structure.

2. An earpiece according to claim 1, wherein the adaptor comprises a snout element provided in a first portion (I) of the earpiece, wherein the barrier structure is provided in a different second portion of the earpiece.

3. An earpiece according to claim 1, wherein the interface comprises a groove portion configured to receive the speaker unit.

4. An earpiece according to claim 1, wherein the adaptable part is essentially symmetric with respect to its longitudinal axis.

5. An earpiece according to claim 1, wherein the adaptor and the adaptable part is made as a single one-piece body.

6. An earpiece according to claim 1, wherein the adaptable part is made in a first material having a first hardness, wherein the adaptor is made in another material having another hardness.

7. An earpiece according to claim 1, wherein the central region of the earpiece, in which the adaptor is arranged, has a first flexibility, wherein the edge end portion of the earpiece has a second flexibility that is larger than the first flexibility.

8. An earpiece configured to be worn in an ear canal of a user, the earpiece comprising:

an adaptor having an interface configured to receive at least a part of a speaker unit and hereby be attached to the speaker unit, an adaptable part, made of a foam material or a gel material shapeable to fit the ear canal of the user, wherein the adaptable part at least partly surrounds the adaptor, the adaptor comprises a sound outlet channel and at least one vent, the at least one vent includes a first section and a second section connected to the first section by one or more additional sections, the first section being connected to an end of the earpiece that is intended to face the eardrum when inserted into the ear canal, and the second section is connected to the opposite end of the earpiece, wherein at least the distal portion of the second section has a larger cross-sectional area than the first section, and the second section is connected to the first section by an additional section comprising a first structure having a smaller cross-sectional area than the first section, and a second structure extending basically perpendicular to the longitudinal axis of the first section of the vent and to the longitudinal axis of the first structure, wherein the length of the second structure exceeds the width of the first structure.

* * * * *